United States Patent [19]

Easton

[11] 4,075,713

[45] Feb. 21, 1978

[54] FEED MIXER

[76] Inventor: Harlan J. Easton, R.F.D. 3, Blooming Prairie, Minn. 55917

[21] Appl. No.: 741,159

[22] Filed: Nov. 11, 1976

[51] Int. Cl.[2] ..... B01F 7/04

[52] U.S. Cl. ..... 366/192; 366/194; 366/306

[58] Field of Search ..... 259/46, 45, 68, 69, 259/9, 10, 109, 110, 178 R

[56] References Cited

U.S. PATENT DOCUMENTS

| | | | |
|---|---|---|---|
| 431,246 | 7/1890 | Billings | 259/109 |
| 2,580,551 | 1/1952 | Kacena | 259/110 |
| 2,961,224 | 11/1960 | Wright | 259/109 |
| 3,203,631 | 8/1965 | Jutila | 259/178 |
| 3,515,374 | 6/1970 | Curley | 259/46 |

*Primary Examiner*—Robert W. Jenkins

*Attorney, Agent, or Firm*—Merchant, Gould, Smith, Edell, Welter & Schmidt

[57] ABSTRACT

A container, having generally vertical end and sidewalls and a semi-cylindrical bottom portion, defines a discharge opening in the bottom portion that is normally closed by an underlying plate-like closure member. Toggle linkage and a closure member engaging cam operate to press the closure member against the bottom portion so as to make sealing contact between the container and the closure member. A feed mixing agitator rotates within the container and includes mixing vanes adjustably mounted on the outer ends of arms extending radially from a rotary shaft journaled in bearings in the end walls of the container.

4 Claims, 5 Drawing Figures

FEED MIXER

BACKGROUND OF THE INVENTION

The present invention is in the nature of an improvement over mixers of granular material of the general type disclosed in U.S. Pat. No. 3,638,920 and others. These prior art devices utilize screw or auger conveyors to effect mixing of material in a hopper-like container, some including rotary agitator vanes or paddles in combination with auger conveyors.

An important object of this invention is the provision of a feed mixer that is highly simplified in structure, that is efficient in its operation, and which utilizes a discharge control arrangement which is effective in preventing leakage of finely ground material from the container.

SUMMARY OF THE INVENTION

The feed mixer of this invention involves a container having generally vertical side and end walls, and a semi-cylindrical bottom wall portion having a discharge opening therethrough. An agitator in the container includes a central shaft, arms extending radially outwardly from the shaft, and mixing vanes on the radially outer ends of said arms. Means journal the shaft in said end walls for rotation generally on the axis of the radius of the bottom wall, and drive means is included for imparting rotation to said agitator, to mix and blend material in said container. Closure means for the discharge opening includes a plate-like closure member having opposite ends, guide means mounting the closure member for movements toward and away from a closed position underlying said discharge opening. Closure member moving means is connected to one end of said closure member for imparting opening and closing movements thereto, and means on said container bottom portion engages the other one of said closure member ends, and cooperates with said closure member moving means to exert sealing pressure to said closure member against the bottom portion responsive to movement of said closure member to its closed position.

DETAILED DESCRIPTION OF THE PREFERRED EMBODIMENT

Figure 1:
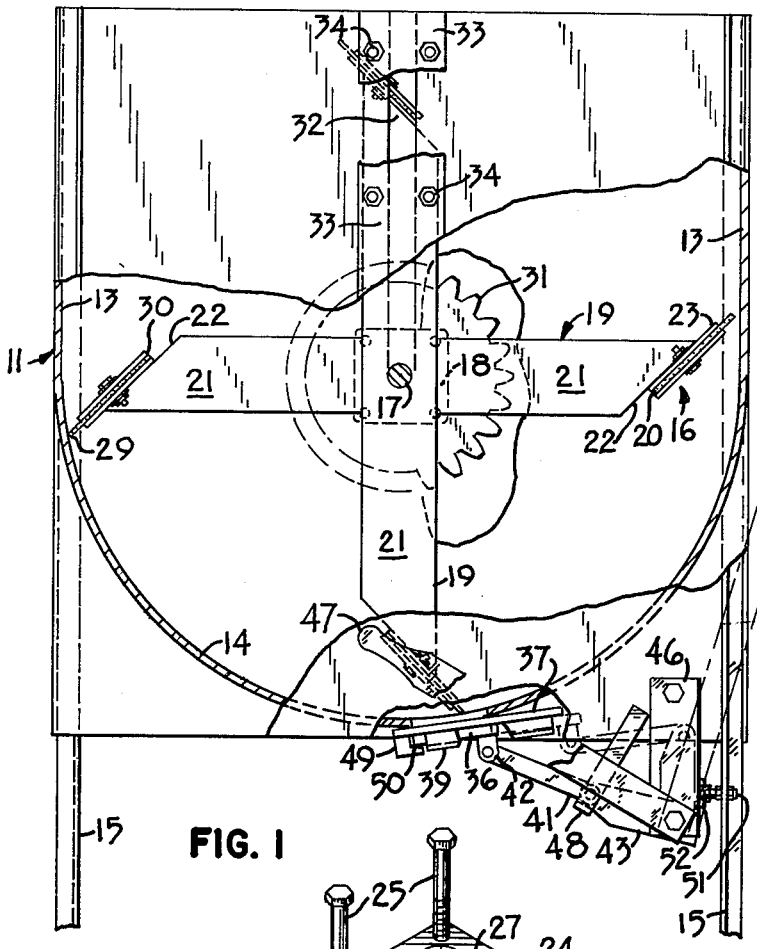
FIG. 1 is a fragmentary view in side elevation of a granular feed mixer produced in accordance with this invention, some parts being broken away and some parts being shown in section.
Figure 2:
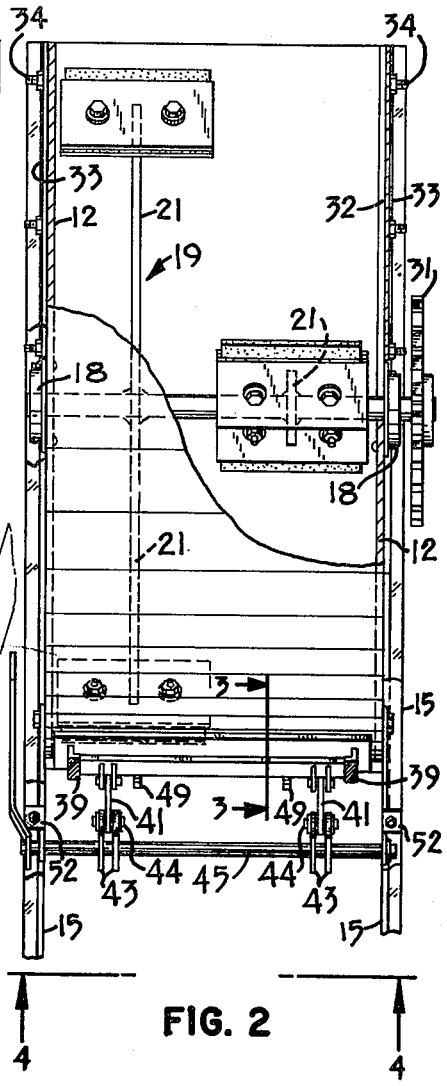
FIG. 2 is a view in end elevation, as seen from the right to the left with respect to FIG. 1, some parts being broken away and some parts being shown in section.

In the drawings, an open topped container, indicated generally at 11, is shown as comprising a pair of spaced vertical end walls 12 and sidewall structure formed to provide laterally spaced generally vertical sidewalls 13 and a semi-cylindrical bottom portion 14. The walls 12 and 13, with bottom portion 14 are preferably made from relatively rigid sheet metal, the end walls 12 being welded or otherwise rigidly secured to opposite ends of the wall structure 13, 14. A supporting frame structure includes vertically extending legs 15 that are welded to opposite side edge portions of the end walls 12. If desired, the open top of the container 11 may be closed by a suitable lid, not shown.

A rotary agitator 16 is disposed within the interior of the container 11, and comprises a shaft 17 that is journaled in bearings 18 that are bolted or otherwise rigidly secured each to a different one of the end walls 12; a pair of elongated bars 19 welded at their longitudinal centers to the agitator shaft 17 in axially spaced relationship thereon and at right angles to each other and paddles or vanes 20 at the opposite ends of the bars 19. The bars 19 define arms 21 the outer ends of which are beveled as indicated at 22.

Figure 5:
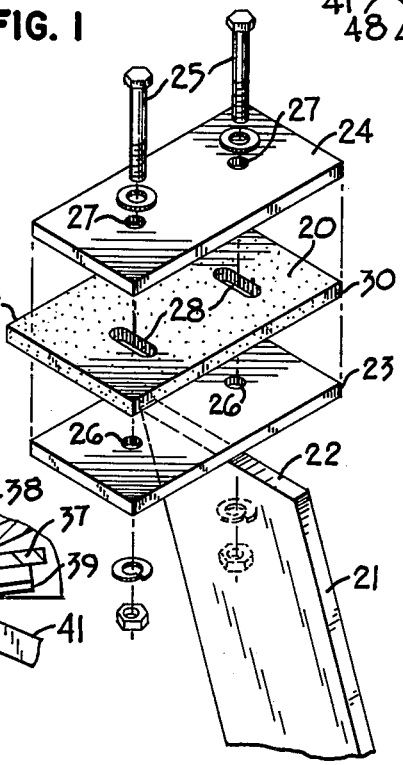
FIG. 5 is a fragmentary view in exploded perspective of one of the mixing vanes of this invention.

Means for mounting the vanes 20 to the outer ends of the arms 21 comprises a plurality of plate-like mounting members 23 each of which is welded to a different one of the beveled ends 22 of the radial arms 21, clamping plates 24 one for each of the mounting members 23, and nut equipped clamping screws 25 that are adapted to extend through aligned openings 26 and 27 in the mounting members 23 and clamping plates 24 respectively, see particularly FIG. 5. The clamping screws 25 are also adapted to extend through slots 28 in the vanes 20 so as to securedly clamp each vane 20 between its respective mounting members 23 and clamping plates 24. As shown, particularly in FIG. 1, the angular relationship of the beveled ends 22 and mounting members 23 to the radial dimensions of their respective arms 21 disposes the vanes 20 so that one edge of each thereof becomes a leading edge and the opposite edge a trailing edge, relative to the direction of rotation of the agitator 16. The leading edges of the vanes 20 are indicated at 29, the trailing edges being indicated at 30. The slots 28 provided for adjustability of the vanes 20 toward and away from engagement of the leading edges 29 thereof with the inner surface of the semi-cylindrical bottom portion 40, the agitator shaft 17 being disposed on the axis of the radius of the bottom portion 14. It will be noted that with the angular displacement of the vanes 20 with respect to the radial dimensions of the arms 21 disposes the leading edges 29 so that they describe a circle of substantially greater diameter than one which is described by the trailing edges 30 during rotation of the agitator 16. Means for imparting rotation to the agiator 16 in a counterclockwise direction with respect to FIG. 1 includes a gear or sprocket wheel 31 secured to the shaft 17 outwardly of one of the end walls 12, and suitable driving means operatively connected to the gear or sprocket 31, these being well known in the art, and not shown. When the leading edges 29 of the vanes 20 become worn, the vanes 20 may be reversed between their respective mounting members 23 and clamping plates 24 so that the unworn trailing edge 30 becomes the leading edge of each vane 20.

The container in walls 12 are formed to provide vertical slots 32 that are disposed centrally between the side walls 13 and which extend downwardly from the upper edges of the end walls 12 to a point slightly below the agitator shaft 17, adjacent portions of the agitator shaft 17 being loosely contained at the bottom portions of the slots 32. Normally, the slots 32 are covered by elongated panels 33 that are secured to the end walls 12 by suitable means such as nut-equipped machine screws or the like 34. When the panels 33 are removed from the end walls 12, and the bearings 18 released from engagement with the end walls 12, the entire agitator structure 16 may be removed upwardly from the interior of the container 11 for service or repairs to the agitator 16 or the interior of the container 11. With the agitator 16 in place as shown, and the panels 33 secured to the end walls 12, the container 11 is secured against leakage of material in the container outwardly through the slots 32.

Figure 3:
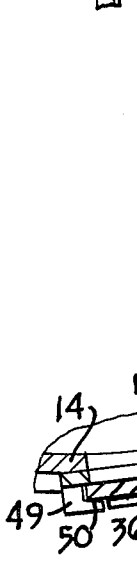
FIG. 3 is an enlarged fragmentary section taken on the line 3—3 of FIG. 2.
Figure 4:
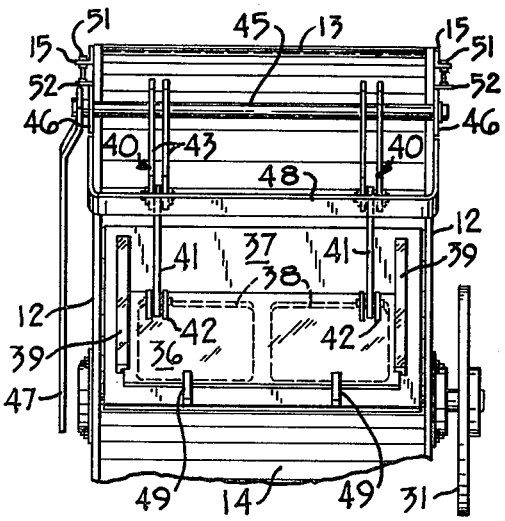
FIG. 4 is a fragmentary view in bottom plan as seen from the line 4—4 of FIG. 2.

The bottom portion 14 of the container 11 is provided with a pair of laterally spaced generally rectangular discharge openings 35 that are normally closed by a plate-like closure member 36. A flat rigid valve plate 37 is rigidly secured to the container bottom portion 14, the valve plate 37 having openings 38 therethrough that coincide with the discharge openings 35, whereby the valve plate 37 has portions that encompass the discharge openings 35. A pair of laterally spaced parallel guide rails 39 are secured to the valve plate 37 for mounting the closure member 36 for sliding movements between a closed position underlying the openings 35 and 38 as shown by full lines in FIGS. 1, 3 and 4, and an open position away from underlying relationship with the openings 35 and 38, as shown by dotted lines in FIG. 1.

Means for imparting movements to the closure member 36 between its open and closed positions comprises a pair of toggles 40 that are spaced apart transversely of the direction of movement of the closure member 36 and in a direction longitudinally or axially of the agitator 16. Each toggle 40 comprises a rigid toggle link 41 having an outer end pivotally secured to a pair of brackets or ears 42 fixed on the closure member 36 adjacent one edge thereof. The inner end of each link 41 is pivotally secured between the inner ends of pairs of rigid links 43, as indicated at 44, the links 43 having outer end portions that are welded or otherwise rigidly secured to axially spaced portions of a rockshaft 45. The rockshaft 45 is journaled at its opposite ends in bearing plates 46 that are bolted to the bottom portions of the end walls 12, the rockshaft 45 being disposed on an axis parallel to the agitator shaft 17, the axes of pivotal connections of the links 41 to the ears 42, and to the axes of the pivotal connections 44 between the links 41 and their respective links 43.

Means for imparting movements to the toggles 41 to move the closure member 36 between its open and closed positions comprises an elongated handle member 47 having one end rigidly secured to one end of the rockshaft 45. As shown by full and dotted lines in FIG. 1, the handle member 47, when raised to its dotted line position, causes the toggle links 41 and 43 to swing in directions to move the closure member 36 to its open position. When the handle member 47 is swung downwardly to its full line position of FIG. 1, the toggle links 42 and 43 are moved to a position slightly beyond a dead center relationship at which point the closure member 36 underlies the aligned discharge openings 35 and 38. A generally U-shaped stop strip 48, secured at its opposite ends to the end walls 12, engages the inner end portions of the links 41 and 43 to limit downward movement thereof slightly beyond said dead center relationship between the links 41 and 43.

A pair of hook-like stop members 49 are welded or otherwise rigidly secured to the valve plate 37 for limiting closing movement of the closure member 36. The stop members 49 are formed to provide cam surfaces 50 that engage the edge of the closure member 36 opposite the ears 42 during closing movement of the closure member 36 to force the upper or inner surface of the closure member 36 into sealing engagement with the adjacent surface of the valve plate 37. It will be noted that, when the closure member 36 is in its closed position, the toggle links 41 are angularly disposed to press the adjacent edge portion of the closure member 36 into sealing engagement with the valve plate 37 in cooperation with the cam surface 50, so that leakage of material through the discharge openings 35 and 38 is effectively prevented.

For the purpose of obtaining a fine adjustment between the toggles 40 and the stop members 49, a pair of nut-equipped stop screws 51 are secured to a pair of the legs 15, the screws 51 engaging outwardly projecting ears 52 on the rockshaft supporting brackets 46. By adjusting the screws 51, the brackets 46 may be swung in either direction with respect to their adjacent legs 15, so as to move the axis of the rockshaft 45 toward or away from the stop members 49.

With the mixer herein disclosed, it has been found possible to thoroughly mix granular feed material very rapidly, particularly materials which have heretofore been quite difficult to mix, such as light fluffy bran with other similar material. While a commercial embodiment of feed mixer has been shown and described, it will be understood that the same is capable of modification without departure from the spirit and scope of the invention, as defined in the claims.

What is claimed is:

1. A granular feed mixer comprising:

a. a container having generally vertical side and end walls, and a semi-cylindrical bottom portion having a discharge opening therethrough;

b. an agitator in said container and including a central shaft, arms extending radially outwardly from said shaft, and mixing vanes on the radially outer ends of said arms;

c. means journaling said shaft in said end walls for rotation generally on the axis of the radius of said bottom portion;

d. drive means for imparting rotation to said agitator, to mix and blend material in said container;

e. and closure means for said discharge opening and including, a plate-like closure member having opposite ends, guide means mounting said closure member for movements toward and away from a closed position underlying said discharge opening, closure member moving means having an end portion connected to one end of said closure member in angularly spaced relation thereto for imparting opening and closing movements thereto, and cam means on said bottom portion engaging the outer end of said closure member and cooperating with said closure member moving means end portion to exert sealing pressure to said closure member against said bottom portion responsive to movement of said closure member to its closed position.

2. The feed mixer defined in claim 1 in which said bottom portion includes a valve plate encompassing said discharge opening, said cam means comprising a cam member on said valve plate, said closure member having sliding engagement with said valve plate and being pressed thereagainst by said end portion and cam means.

3. The feed mixer defined in claim 2, characterized by support frame structure for said container, said closure member moving means including a pair of cooperating links having inner ends pivotally connected together to provide a toggle, one of said links compresing said end portion and having an outer end pivotally connected to said closure member, the other of said links having an outer end operatively pivotally supported from said container and means for imparting pivotal movements to said links toward and away from a dead center relationship between said links.

4. The feed mixer defined in claim 3, characterized by a rockshaft journaled for pivotal movements relative to said support frame, said outer end of said other link being rigidly connected to said rockshaft for pivotal movements therewith, said last mentioned means comprising a handle member extending radially outwardly from said rockshaft and secured thereto.

* * * * *